US006196415B1

(12) United States Patent
Sullivan

(10) Patent No.: US 6,196,415 B1
(45) Date of Patent: Mar. 6, 2001

(54) SINGLE COPY NEWSPAPER DISPENSER

(76) Inventor: Melvin N. Sullivan, 4614 Old Spartanburg Rd. Apt # 32, Taylors, SC (US) 29687

( * ) Notice: Subject to any disclaimer, the term of this patent is extended or adjusted under 35 U.S.C. 154(b) by 0 days.

(21) Appl. No.: 09/259,350

(22) Filed: Mar. 1, 1999

(51) Int. Cl.[7] ..... B65H 3/00
(52) U.S. Cl. ..... 221/192; 221/259
(58) Field of Search ..... 221/192, 191, 221/210, 259, 232, 227, 241, 213, 251

(56) References Cited

U.S. PATENT DOCUMENTS 4,496,074 * 1/1985 Owens ..... 221/259
6,003,725 * 12/1999 Blankenau et al. ..... 221/259

* cited by examiner

*Primary Examiner*—Kenneth W. Noland
(74) *Attorney, Agent, or Firm*—James Ray & Associates

(57) ABSTRACT

An access door provided in a dispenser, for access by a delivery person to an interior of the dispenser where a stack of newspapers are stored. A coin box is provided on a top wall of the dispenser. The coin box operates in a known manner to permit operation of a pull bar after the correct amount of payment has been received into the coin box. The pull bar urges against the top-most one of the newspapers when a customer pulls the pull bar, thus pushing the newspaper onto a dispensing tray and through a slot in the dispenser, thus presenting the newspaper to the customer. The customer may then take the newspaper for his or her use. When the newspaper is pushed forward, a hinged security flap rotates upward to permit the newspaper to pass through the slot. A platform is positioned within the interior of the dispenser. The newspapers are stacked upon the platform, which is raised by a lifting device, which is configured to urge the stack of the newspapers against a stop member, which is positioned at a top of the interior of the dispenser. A positioning device is provided on the dispenser for vertically positioning the stop member. In one embodiment, the positioning device is a manual device accessible only to the delivery person. After the delivery person stacks the newspapers onto the platform, he or she can position the stop member so that when the stack of newspapers is urged against the stop member, only the top-most one of the newspapers is positioned to slide onto the dispensing tray when urged by the pull bar.

7 Claims, 1 Drawing Sheet

SINGLE COPY NEWSPAPER DISPENSER

BACKGROUND OF THE INVENTION

1. Field of the Invention

The present invention relates to dispensers, particularly to newspaper dispensers.

2. Description of the Related Art

Newspaper dispensers of the prior art are generally not capable of dispensing only one newspaper at a time. With the conventional newspaper dispenser, the honor system is relied upon because it is possible for a customer to pay for one newspaper, and then reach into the dispenser and take several newspapers.

What is needed is a newspaper stand which dispenses only one newspaper at a time, which is inexpensive to manufacture and maintain, and which is easy to use.

SUMMARY OF THE INVENTION

The single copy newspaper dispenser of the present invention includes an access door provided in a front wall of the dispenser, for access by a delivery person to an interior of the dispenser where a stack of newspapers are stored.

A coin box is provided on a top wall of the dispenser. The coin box operates in a known manner to permit operation of a pull bar after the correct amount of payment has been received into the coin box. The pull bar urges against the top-most one of the newspapers when a customer pulls the pull bar, thus pushing the newspaper onto a dispensing tray and through a slot in the front wall, thus presenting the newspaper to the customer. The customer may then take the newspaper for his or her use. When the newspaper is pushed forward, a hinged security flap rotates upward to permit the newspaper to pass through the slot.

A platform is positioned within the interior of the dispenser. The newspapers are stacked upon the platform, which is raised by a lifting means, which is configured to urge the stack of the newspapers against a stop member, which is positioned at a top of the interior of the dispenser.

A positioning means is provided on the dispenser for vertically positioning the stop member. In one embodiment, the positioning means is a manual device accessible only to the delivery person. After the delivery person stacks the newspapers onto the platform, he or she can position the stop member so that when the stack of newspapers is urged against the stop member, only the top-most one of the newspapers is positioned to slide onto the dispensing tray when urged by the pull bar.

Still further features and advantages will become apparent from the ensuing description and drawings.

DETAILED DESCRIPTION

Figure 1:
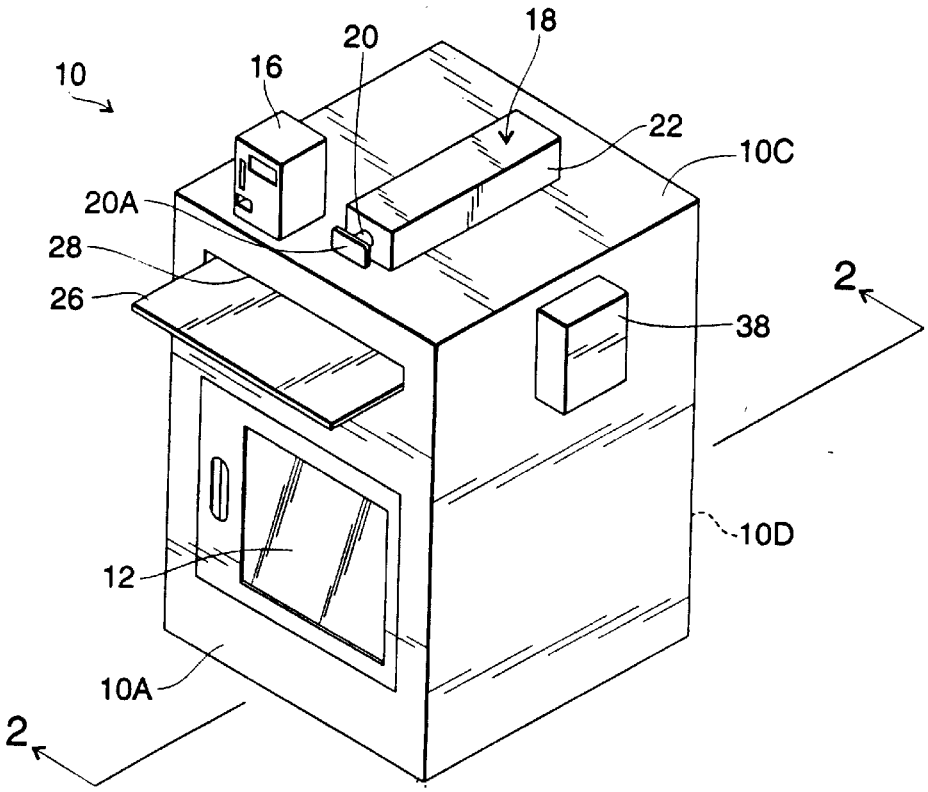
FIG. 1 is a perspective view of a newspaper dispenser of the present invention.
Figure 2:
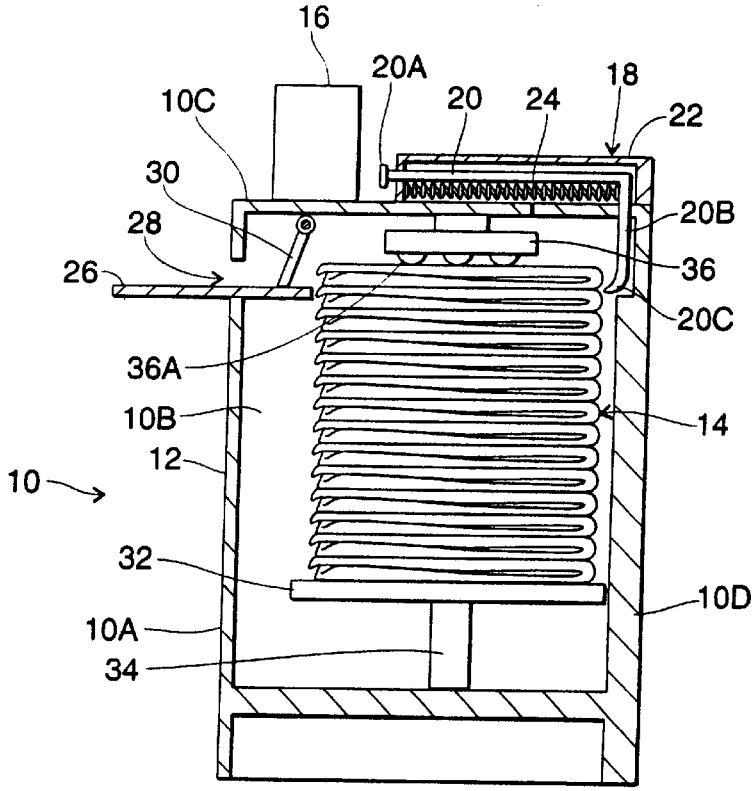
FIG. 2 is a cross-sectional view of the dispenser, taken along line 2—2 of FIG. 1.

FIG. 1 is a perspective view of a newspaper dispenser 10 of the present invention. FIG. 2 is a cross-sectional view of the dispenser 10, taken along line 2—2 of FIG. 1.

Referring to both figures, an access door 12 is provided in a front wall 10A of the dispenser 10, for access by a delivery person (not shown) to an interior 10B of the dispenser 10 where a stack of newspapers 14 is stored. The access door 12 is normally locked, so that customers (not shown) may not access the interior 10B to take more than one newspaper 14.

A coin box 16 is provided on a top wall 10C of the dispenser 10. A dispensing means 18 is also provided on the top wall 10C of the dispenser 10. The dispensing means 18 includes a pull bar 20 within a housing 22. The pull bar 20 is pulled forward by a customer (not shown) to dispense a top-most one of the newspapers 14. The coin box 16 operates in a known manner to permit operation of the pull bar 20 after the correct amount of payment has been received into the coin box 16.

The pull bar 20 includes a handle 20A at a front end thereof, and a downwardly extended arm 20B at a rear end thereof A spring means 24 is arranged to normally urge the arm 20B of the pull bar 20 toward a rear wall 10D of the dispenser 10. The arm 20B includes a curved distal end 20C which urges against the top-most one of the newspapers 14 when the customer (not shown) pulls the pull bar 20, thus pushing the newspaper 14 onto a dispensing tray 26 and through a slot 28 in the front wall 10A, thus presenting the newspaper 14 to the customer (not shown). The customer (not shown) may then take the newspaper 14 for his or her use. When the newspaper 14 is pushed forward, a hinged security flap 30 is urged by the newspaper 14 to rotate upward to permit the newspaper 14 to pass through the slot 28.

A platform 32 is positioned within the interior 10B of the dispenser 10. The newspapers 14 are stacked upon the platform 32, which is raised by a lifting means 34. The lifting means 34 may be a spring, or a motorized lifting mechanism which would be configured using known structure. Whether the lifting means 34 is a spring, or a motorized lifting mechanism, it is configured to urge the stack of the newspapers 14 against a stop member 36, which is positioned at a top of the interior 10B of the dispenser 10, beneath the top wall 10C.

The stop member 36 includes rollers 36A which permit the top-most one of the newspapers 14 to move forward onto the dispensing tray 26 without excessive friction. In the embodiment shown, the rollers 36A do not include a drive mechanism; they rotate only under influence of the newspaper 14 moving beneath them.

A positioning means 38 is provided on the dispenser 10 for vertically positioning the stop member 36. In one embodiment, the positioning means 38 is a manual device accessible only to the delivery person (not shown). After the delivery person stacks the newspapers 14 onto the platform 32, he or she can use the positioning means 38 to position the stop member 36 so that when the stack of newspapers 14 is urged against the stop member 36, only the top-most one of the newspapers 14 is positioned to slide onto the dispensing tray 26 when urged by the arm 20B of the pull bar 20. After the newspaper 14 is removed by the customer (not shown), the lifting means 34 will raise the stack of newspapers 14 until the new top-most newspaper 14 urges against the stop member 36. If the lifting means 34 is a spring, this will occur naturally after the newspaper 14 is removed. If the lifting means 34 is a motorized lifting mechanism, the lifting means 34 can be activated by a switch (not shown) which would energize the lifting means 34 after the newspaper 14 has been removed. The switch could be actuated, for example, when the security flap 30 returns to its original position after the newspaper 14 is removed.

The foregoing description is included to describe embodiments of the present invention which include the preferred embodiment, and is not meant to limit the scope of the invention.

From the foregoing description, many variations will be apparent to those skilled in the art that would be encompassed by the spirit and scope of the invention. For example, and not by way of limitation, the positioning means may include a laser or other electronic sensing device which senses the thickness of the top-most newspaper and automatically positions the stop member as necessary to permit only the top-most newspaper to be dispensed onto the dispensing tray. In addition, the coin box may be replaced by other types of payment reception means, such as a bill or card reader. Furthermore, the dispensing means may be a known type of urging member which is manually or automatically operated, in lieu of the pull bar shown and described. Accordingly, the scope of the invention is to be limited only by the following claims and their legal equivalents.

The invention claimed is:

1. A single copy newspaper dispenser comprising:

a. an enclosure;

b. a payment reception means disposed on said dispenser accessible from outside the enclosure;

c. a platform within said enclosure;

d. a stop member, disposed at a top portion of said dispenser within said enclosure, positioned above the platform;

e. the platform adapted to receive a stack of newspapers thereon;

f. a lifting means engageable with said platform configured to raise the platform until such stack of newspapers is urged against the stop member;

g. a dispensing means operatively connected to said payment reception means, disposed on said dispenser, for dispensing a top-most one of such newspapers through an opening in the enclosure, said dispensing means including a pull bar within a housing, said pull bar is springedly urged in a direction away from said opening of said enclosure, said pull bar having a downwardly extended arm extending within said enclosure for urging such top-most one of such newspapers toward said opening of said enclosure when said pull bar is pulled; and h. a positioning means, disposed on said dispenser, for positioning the stop member so that when the stack of newspapers is urged against the stop member, only such top-most one of such newspapers is dispensable through the opening in the enclosure.

2. The dispenser of claim 1, wherein the lifting means includes a spring configured to urge the platform in the direction of the stop member.

3. The dispenser of claim 1, wherein the lifting means is a motorized lifting mechanism.

4. The dispenser of claim 1, wherein the positioning means is manually operable.

5. The dispenser of claim 1, wherein a dispensing tray is horizontally disposed in said opening in said enclosure for receiving such top-most one of such newspapers.

6. The dispenser of claim 1, wherein said downwardly extended arm of said pull bar has a curved distal end for engaging a folded end of such top-most one of such newspapers.

7. The dispenser of claim 1, wherein said dispenser further includes a hinged security flap disposed within said enclosure so as to block said opening in said enclosure, said hinged security flap rotatings upwardly when urged by such newspaper being dispensed through said opening in said enclosure.

* * * * *